United States Patent [19]

Lehmann

[11] Patent Number: 4,721,039

[45] Date of Patent: Jan. 26, 1988

[54] METHOD AND CONTROL APPARATUS FOR SEPARATING THE ROLLS OF A CALENDER

[75] Inventor: Rolf Lehmann, Rudolfstetten, Switzerland

[73] Assignee: Sulzer-Escher Wyss AG, Zürich, Switzerland

[21] Appl. No.: 14,782

[22] Filed: Feb. 13, 1987

[30] Foreign Application Priority Data

Feb. 18, 1986 [CH] Switzerland ..... 00655/86

[51] Int. Cl.[4] ..... B30B 15/16; B21B 31/32

[52] U.S. Cl. ..... 100/47; 100/163 R; 72/245; 29/113 AD

[58] Field of Search ..... 100/163 R, 35, 47, 168, 100/169, 170, 163 A, 162 B, 51; 29/113 AD, 116 R, 116 AD; 72/243, 245

[56] References Cited

U.S. PATENT DOCUMENTS

| | | | |
|---|---|---|---|
| 3,777,656 | 12/1973 | Muller | 100/47 |
| 4,154,160 | 5/1979 | Kusters | 100/162 B X |
| 4,290,351 | 9/1981 | Pav et al. | 100/163 A X |
| 4,347,784 | 9/1982 | Pav et al. | 100/168 X |
| 4,380,954 | 4/1983 | Edele | 100/47 X |
| 4,389,933 | 6/1983 | Pav | 29/116 AD X |
| 4,481,799 | 11/1984 | Glattfelder et al. | 29/116 AD X |

*Primary Examiner*—Daniel P. Stodola
*Assistant Examiner*—Steven M. DuBois
*Attorney, Agent, or Firm*—Werner W. Kleeman

[57] ABSTRACT

The bottom roll of a roll stack in a calender is constructed as a controlled deflection roll equipped with a non-rotatable carrier or support beam and a roll shell rotatable about the non-rotatable carrier. The roll shell is supported on the non-rotatable carrier by means of hydraulic support or pressure elements. The non-rotatable carrier is supported with respect to the calender stand by means of hydraulic carrier support devices. For the rapid opening of the calender and to avoid damage to the roll shell, initially the pressure exerted on the roll shell support elements is reduced in a sudden manner and only after a predetermined time-delay is there reduced the pressure exerted on the carrier support devices. The time-delay is chosen such that the pressure peak occurring in the roll shell support elements due to the springing back or recovery of the non-rotatable carrier has dropped to a safe value and the risk of damage to the roll shell, such as would occur in the case of a simultaneous pressure drop, is avoided.

9 Claims, 2 Drawing Figures

METHOD AND CONTROL APPARATUS FOR SEPARATING THE ROLLS OF A CALENDER

BACKGROUND OF THE INVENTION

The present invention relates to a new and improved method and control apparatus for separating the rolls of a roll calender, in other words to open the roll calender.

Generally speaking, the roll calender or simply calender comprises a stand and a plurality of superimposed rolls are supported by the stand. The bottom or lowermost roll of this stack or set of superimposed rolls comprises a non-rotatably mounted carrier or support beam which is substantially vertically movable by means of fluid-operated, typically hydraulic support devices. This bottom roll further contains a roll shell rotatable about the non-rotatable carrier or support beam. The roll shell is supported by at least one hydraulic support or pressure element against the non-rotatable carrier or support beam and is movable in substantially vertical direction. The pressure which is effective both in the hydraulic carrier support devices and at the hydraulic roll shell support elements, is reduced, so that both the non-rotatable carrier or support beam and the roll shell are moved substantially vertically downwards in order to open the calender.

Such a method is known to the art through placement of such a calender into operation in the Augsburg factory of Haindl Papier GmbH, of West Germany, on Jan. 17, 1980.

This roll calender or calender essentially corresponds to the construction described in U.S. Pat. No. 3,884,141, wherein the bottom or lowermost roll is constructed as a so-called sag compensation roll or controlled deflection roll of the type described in U.S. Pat. No. 3,885,283, granted May 27, 1975, in which the roll shell is freely movable with respect to the carrier or support beam in vertical direction within the degree of the freedom of movement or motion clearance of the support or pressure elements. The carrier or support beam is additionally supported at its ends or bearings with respect to the roll stand by means of hydraulic, e.g. hydrostatic support devices. The closing of the calender, i.e. the raising of the complete stack or set of rolls takes place by pressurizing or pressure impingement of both the hydraulic roll shell support elements and the hydrostatic carrier support devices.

It is also possible to rapidly open the calender, i.e. rapidly lower the complete roll stack or set until the individual rolls rest on associated stops, in that both the pressure acting upon the hydraulic roll shell support elements and upon the hydrostatic carrier support devices is reduced by opening corresponding valves. Through the movement of both the non-rotatable carrier or support beam with respect to the roll stand and the roll shell with respect to the non-rotatable carrier, particularly in the case of calenders for the processing of paper, plastic or other materials, when a fault occurs, e.g. tearing of a web, it is possible to rapidly separate the calender rolls from one another and therefore the risk of damage is reduced to the minimum.

In the similarly constructed calender described in German Pat. No. 3,004,912, it is proposed to simultaneously open the valves of the pressure lines or conduits for the carrier support devices and the roll shell support elements. When using this method or technique with simultaneously commencing lowering of the carrier and roll shell, difficulties were however encountered, particularly in the case of calenders operating with a high pressing pressure or force and when attempting to obtain particularly short roll separating times, in other words, during rapid opening of the roll calender. On the one hand, it was not readily possible to reduce the separating time of the roll stack to the desired short times and, on the other hand, particularly in the case of high pressing pressures, there occurred damage, such as fissures or fractures of the roll shell of the controlled deflection roll, the cause of which was apparently not readily discernible or understood.

SUMMARY OF THE INVENTION

Therefore, with the foregoing in mind, it is a primary object of the present invention to provide a new and improved method of and control apparatus for separating the rolls of a calender which do not exhibit the aforementioned drawbacks and shortcomings of the prior art.

A further significant object of the present invention aims at obviating the aforenoted drawbacks and shortcomings of the prior art, and, in particular, devising an improved method of, and apparatus for, opening a roll calender and for separating the roll stack or set thereof such that the roll separating time is reduced, yet there is avoided damage to the roll shell of the controlled deflection roll or the like of the roll calender.

Still another and more specific object of the present invention relates to a new and method of and apparatus for opening a roll calender in a highly efficient and reliable manner, both extremely quickly and protectively with respect to avoiding damage to the rolls, particularly the roll shell of a controlled deflection roll used in the roll calender.

Yet a further significant object of the present invention aims at providing a new and improved control apparatus for reliably separating in a highly protective manner the rolls of a calender and which control apparatus is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the method of the present invention is manifested by the features that the pressure in the hydraulic carrier support devices is reduced with a predetermined time-delay compared with the pressure reduction at the hydraulic roll shell support elements.

As alluded to above, the invention is not only concerned with the aforementioned method aspects, but also concerns an improved control apparatus for controlling the opening of a roll calender and which is manifested by the features that there is provided a switching device for reduction of the pressure at the hydraulic roll shell support elements and a switching device for the reduction of the pressure in the hydraulic carrier support devices. According to the invention, there is provided a time-delay device which enables the pressure reduction in the hydraulic carrier support devices to first occur after a certain time-delay or time-lag following the pressure reduction at the hydraulic roll shell support elements.

In this way, firstly the pressure acting at or upon the hydraulic support elements of the roll shell is reduced and then, following a given time-delay, is there reduced the pressure in the support devices of the carrier or support beam. The time-delay or time-lag is advantageously chosen to lie in the range between 1/100 and ½ second, preferably so as to amount to approximately 1/10 second.

In an advantageous further development of the invention, the lowering of the carrier or support beam of the controlled deflection roll is first initiated by means of suitable sensors only when a point or location on the carrier has moved through a predetermined distance with respect to a fixed or reference point, e.g. constituted by a support element, the roll shell or the roll stand of the calender.

It is particularly advantageous to measure the pressure course in one of the pressure chambers of the support elements, e.g. by using a suitable pressure sensor, and to only then initiate the lowering of the carrier or support beam of the controlled deflection roll when the pressure in this pressure chamber has dropped to a given or predeterminate safe value.

The invention is based on the important and novel recognition that in the case of a rapid pressure reduction or drop at the roll shell support elements, e.g. due to a rapid opening of the valve of the pressure lines or conduits, the carrier or support beam which is pre-biased or loaded and deflected by the hydraulic forces springs back or returns into the unloaded or unstressed state in the case of a sudden pressure relief. This leads to an instantaneous pressure rise in the pressure chambers of the roll shell support elements, so that immediately after opening of the valve the roll shell does not drop downwards as a result of its weight or the force of gravity and open the calender. The magnitude of this pressure rise in the individual pressure chambers is dependent on the locally differing recovery or springing back action of the carrier or support beam of the controlled deflection roll. Since the recovery of the carrier or support beam takes place very rapidly, the pressure instantaneously building up in the pressure chambers of the support elements for the roll shell cannot decrease rapidly enough via the valve in the pressure lines or conduits and part of the pressure or pressurized medium is forced out of the support elements. A certain time is required for the reduction of the instantaneously raised pressure.

If the carrier or support beam of the controlled deflection roll or sag compensating roll is simultaneously lowered before the pressure in the support elements of the roll shell has been reduced to a safe value, then, as a result of the previously described locally differing recovery of the carrier or support beam, a gap or space can form between the roll shell of the controlled deflection roll or the like and the calender roll located above it and such a high force can be momentarily exerted on the roll shell that the latter can be damaged.

According to the present invention, this is avoided in that the valve for lowering the carrier or support beam of the controlled deflection roll is opened with an adequate time-lag or time-delay, within which the pressure acting at or upon the roll shell support elements has dropped to a safe value. This obviates the risk of the roll shell being damaged and the pressure reduction can take place in a surge-like or sudden manner, i.e. the valves of the pressure lines or conduits can be immediately fully opened. Thus, the roll stack separating time is reduced to a minimum without any risk of damage.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
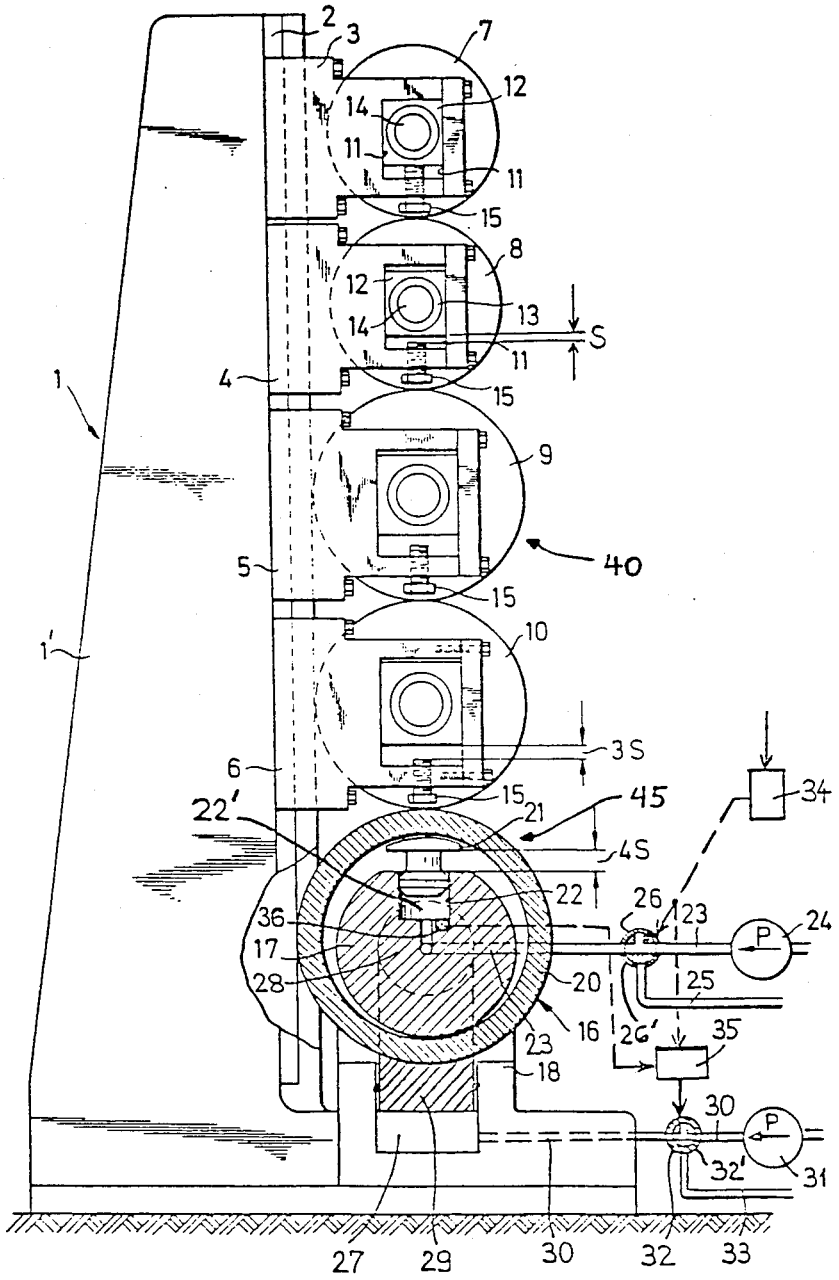
FIG. 1 illustrates in side view a roll calender constructed according to the invention.
Figure 2:
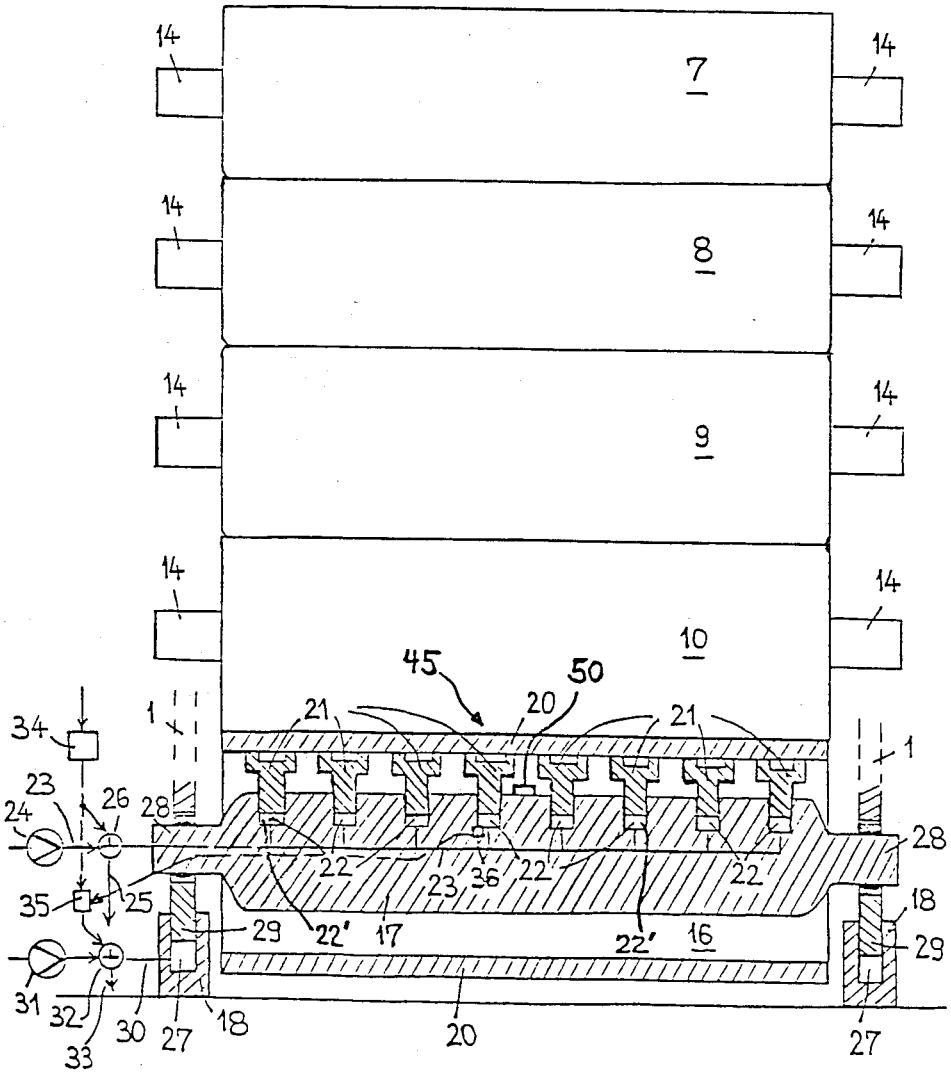
FIG. 2 illustrates the roll calender of FIG. 1 in front view.

Describing now the drawings, it is to be understood that to simplify the showing thereof, only enough of the structure of the exemplary embodiment of control apparatus for a roll calender for separating the rolls of such roll calender has been shown therein as is needed to enable one skilled in the art to readily understand the underlying principles and concepts of this invention. Turning now specifically to FIGS. 1 and 2 of the drawings, the control apparatus illustrated therein by way of example and not limitation, will be seen to comprise a roll stand or stand 1, which can have, for example, a frame-shaped construction and contains two vertical side parts or components 1'. Each side part 1' is provided with a guide or guide structure 2, to which are fixed bearing blocks 3, 4, 5 and 6 of rolls 7, 8, 9 and 10 of the roll calender, generally indicated by reference character 40. The bearing blocks 3, 4, 5 and 6 can be appropriately moved along the guide or guide structure 2. The actual bearing blocks 3, 4, 5 and 6 are provided with guides or guide means 11, in which there are guided bearing blocks 12 of the individual rolls 7, 8, 9 and 10. The individual bearing blocks 12 contain bearing bushings 13, in which there are rotatably mounted journals 14 of the associated rolls 7, 8, 9 and 10. The downward movement of the bearing blocks 12 is limited by associated stop screws or stops 15, which are adjusted in such a way that with the calender open, the necessary clearance S is obtained between the individual rolls.

The bottom or lowermost roll 16 of the roll calender 40 is constructed as a controlled deflection roll 45 and contains a non-rotatable carrier or support beam 17, whose journals 28 are supported by hydraulic support devices 18 and can be raised up to conventional and thus not particularly shown stops. About this non-rotatable but positionally shiftable or elevatable carrier or support beam 17 there is mounted for rotation a roll shell 20 of the controlled deflection roll 45. The roll shell 20 is mounted or supported on hydrostatic support or pressure elements 21 and is supported or braced in relation to the carrier or support beam 17 as is well known in this art. These hydrostatic support elements 21 are here constructed in the form of piston-like components or parts which are guided in associated cylinder bores or compartments 22 of the carrier or support beam 17 and form a pressure chamber 22' together therewith. A suitable hydraulic pressure or pressurized medium is supplied at a given or predeterminate pressure from a pump 24 via the line or conduit 23 to these pressure chambers 22'.

The line or conduit 23 contains a switching device 26 or mechanism, which can, for example, be constructed as a three-way valve 26'. This three-way valve 26' permits a disconnection of the pump 24 from the pressure chambers 22' and an instantaneous pressure relief through the outflow of the pressure medium via the line or conduit 25. This also leads to a reduction in the force exerted by the hydraulic support or pressure elements 21 on the roll shell 20, and the support elements 21 and roll shell 20 drop into their lowest or lowermost position, so that the calender 40 is opened.

As is shown in FIG. 2, the roll shell 20 of the controlled deflection roll 45 is generally supported on a plurality of the support or pressure elements 21 which are for instance arranged in a row. These support or pressure elements 21 can be, for example, constructed in the manner described in the U.S. Pat. No. 3,802,044, granted Apr. 9, 1974, i.e. as support or pressure elements equipped with hydrostatic pressure pockets on their bearing surfaces. However, it is also possible to use a single ledge-like support or pressure element which extends along a significant part of the axial length of the roll shell 20. Moreover, the support or pressure elements also can be constructed as hydraulically pressed support or pressure elements with hydrodynamic bearing surfaces, or as hydraulic pressure cushions on the top or surface of the carrier or support beam.

As shown in the exemplary embodiment under discussion, the hydraulic support devices 18 of the carrier or support beam 17 of the controlled deflection roll 45, can be constructed as hydrostatic bearing support devices each equipped with a piston 29 which is substantially vertically movable in an associated pressure chamber or cylinder 27 and connected to the journals 28 of the carrier or support beam 17. A pump 31 also supplies the pressure chambers or cylinders 27 with a suitable hydraulic pressure or pressurized medium at a given or predeterminate pressure by means of the lines or conduits 30. As a matter of convenience in illustration there is only shown in FIG. 2 the line or conduit 30 leading from the pump 31 to the pressure chamber or cylinder 37 located at the left-hand side of such FIG. 2. In the line or conduit 30 there is also provided a switching device or mechanism 32, for example, a three-way valve 32', which makes it possible to disconnect the pump 31 and to relieve the pressure in the pressure chambers or cylinders 27 through an outflow of the pressure medium via the lines or conduits 33.

The switching devices or mechanisms 26 and 32 can be controlled by means of a control device 34 and can be switched over from the pressure medium supply position or mode into the pressure relief position or mode. The switching over or reversing of the switching device or mechanism 26 for the pressure drop in the pressure chambers 22' of the roll shell support elements 21, takes place immediately following the activation or triggering of the control device 34, which can take place manually or through a suitable detector indicating a defect in the rolled web or web of material. The control of the switching element 32 for the pressure chambers or cylinders 27 of the carrier support devices 18, takes place by means of a time-delay or time-lag element or circuit 35. This time-delay element or circuit 35 ensures that the switching over of the switching device or mechanism 32 for the carrier support devices 18 only takes place following a certain time-delay or time-lag after the switching over of the switching device or mechanism 26 or the pressure relief of the roll shell support elements 21.

The time-delay or time-lag of the time-delay element or circuit 35 is chosen in such a way that following a pressure peak in the pressure chambers 22' of the individual roll shell support elements 21 as a result of the previously discussed carrier or support beam recovery, the pressure in even the most highly loaded pressure chambers, preferably at the center or central region of the carrier or support beam 17, returns to a safe value. Experience has shown that the time-delay or time-lag should be at least 1/100 second. However, the time-delay or time-lag should not be too long, i.e. generally no longer than ½ second so as not to lose the advantageous effect of the pressure drop both in the pressure chambers 22' of the roll shell support elements 21 and in the carrier support devices 18. It has been found that the risk of roll shell damage is considerably reduced if the time-delay is roughly 1/10 second.

A particularly advantageous further development is obtained if in a particularly highly loaded pressure chamber 22', which is e.g. located in the center or central region of the carrier or support beam 17, an appropriate pressure sensor 36 is provided (see FIG. 2). This pressure sensor 36 additionally controls the time-delay element or circuit 35 and ensures that the switching device or mechanism 32 is only triggered when, following a pressure peak in this pressure chamber 22', the pressure has dropped to a predeterminate threshold value. This leads to an even better security against damage to the roll shell 20.

In place of a pressure sensor, a similar advantageous effect can be obtained by using a position sensor or detector, such as generally indicated by reference character 50 in FIG. 2, which measures the movement of the carrier or support beam 17 during the springing back or recovery action and the fixed or reference point can, for example, be constituted by an associated support element 21, the roll shell 20 or the stand 1. The time-delay element 35 is then only released or activated by the sensor 50 when the carrier or support beam 17 has sprung back by a predetermined amount at the measuring point or location. This recovery amount is appropriately chosen in such a way that the pressure peak in the pressure chambers 22' has then been reduced to such an extent that there is no longer any risk of the roll shell 20 becoming damaged during lowering of the carrier or support beam 17.

While there are shown and described present preferred embodiments of the invention, it is to be distinctly understood that the invention is not limited thereto, but may be otherwise variously embodied and practiced within the scope of the following claims. Accordingly,

What I claim is:

1. A method for separating the rolls of a calender containing a roll stand and equipped with a plurality of superimposed rolls, comprising the steps of:

providing as one of the superimposed rolls a bottom roll having a non-rotatably mounted carrier which is substantially vertically movable by means of hydraulic carrier support devices pressurizable by means of a pressurized medium and upon which non-rotatably mounted carrier there is supported by means of at least one hydraulic support element pressurizable by means of a pressurized medium a roll shell which is movable in substantially vertical direction;

separating the rolls of the calender by lowering the pressure in the hydraulic carrier support devices and the pressure exerted upon the at least one hydraulic roll shell support element such that both said carrier and said hydraulic roll shell are moved substantially vertically downwards; and said step of lowering the pressure entails the initialization of the lowering of the pressure in the hydraulic carrier support devices with a predeterminate time-delay after the initialization of the lowering of the pressure exerted upon said at least one hydraulic roll shell support element.

2. The method as defined in claim 1, further including the step of:

selecting said predeterminate time-delay to amount to at least 1/100 second.

3. The method as defined in claim 1, further including the step of:

selecting said predeterminate time-delay such that said predeterminate time-delay does not exceed ½ second.

4. The method as defined in claim 1, further including the step of:

selecting said predeterminate time-delay such that said predeterminate time-delay amounts to approximately 1/10 second.

5. The method as defined in claim 1, further including the steps of:

measuring the pressure course in a pressure chamber of said at least one roll shell support element; and initiating the lowering of the pressure in pressure chambers of the hydraulic carrier support devices only when the measured pressure in the pressure chamber of said roll shell support element has dropped below a predeterminate value.

6. The method as defined in claim 1, further including the steps of:

measuring the position of at least one point of the non-rotatably mounted carrier; and initiating the lowering of the pressure in pressure chambers of the carrier support devices only when the measured position of the non-rotatably mounted carrier has changed in a predetermined manner.

7. A control apparatus for separating the rolls of a calender containing a roll stand and equipped with a plurality of superimposed rolls, comprising:

a bottom roll defining one of said plurality of superimposed rolls of the calender;

said bottom roll comprising a non-rotatably mounted carrier and a roll shell mounted for rotational movement about said carrier;

hydraulic carrier support devices for moving said non-rotatably mounted carrier in substantially vertical direction;

means for applying a pressurized fluid medium to said hydraulic carrier support devices for said non-rotatably mounted carrier;

at least one hydraulic support element for supporting said roll shell upon said non-rotatably mounted carrier and movable in substantially vertical direction;

means for applying a pressurized fluid medium to said at least one hydraulic support element;

a switching device for reducing the pressure acting upon said at least one support element for the roll shell;

a switching device for reducing the pressure in said hydraulic carrier support devices; and a time-delay device which only permits the reduction in pressure in said hydraulic carrier support devices following a predetermined time-delay after the reduction of the pressure acting upon said at least one hydraulic support element.

8. The control apparatus as defined in claim 7, further including:

at least one pressure chamber provided for said at least one hydraulic support element;

a pressure sensor arranged in said at least one pressure chamber of said at least one hydraulic support element;

said pressure sensor being operatively connected to said time-delay device and controlling said time-delay device in such a manner that said switching device for the reduction of the pressure in said hydraulic carrier support devices is only operated when the pressure measured by said pressure sensor in the at least one pressure chamber has dropped below a predetermined threshold value.

9. The control apparatus as defined in claim 7, further including:

a position sensor disposed at one predeterminate point on the non-rotatably mounted carrier;

said position sensor measuring the position of said non-rotatably mounted carrier with respect to a fixed point; and said position sensor being operatively connected to said time-delay device and controlling said time-delay device in such a manner that said time-delay device only triggers said switching device for the reduction in pressure in said hydraulic carrier support devices when the measured position of the non-rotatably mounted carrier reaches a predetermined value.

* * * * *